US008519891B2

(12) United States Patent
Chen

(10) Patent No.: US 8,519,891 B2
(45) Date of Patent: Aug. 27, 2013

(54) DUAL-POLARIZED DUAL-FEEDING PLANAR ANTENNA

(75) Inventor: Tai-Lee Chen, Taipei (TW)

(73) Assignee: National Central University, Jhongli, Taoyuan County (TW)

( * ) Notice: Subject to any disclaimer, the term of this patent is extended or adjusted under 35 U.S.C. 154(b) by 196 days.

(21) Appl. No.: 13/171,436

(22) Filed: Jun. 28, 2011

(65) Prior Publication Data

US 2012/0119954 A1 May 17, 2012

(30) Foreign Application Priority Data

Nov. 17, 2010 (TW) ..... 99139594 A

(51) Int. Cl.
*H01Q 1/38* (2006.01)

(52) U.S. Cl.
USPC ..... 343/700 MS; 343/850; 343/852

(58) Field of Classification Search
USPC ..... 343/700 MS, 893, 767, 770, 850, 343/852
See application file for complete search history.

(56) References Cited

U.S. PATENT DOCUMENTS

| | | | | |
|---|---|---|---|---|
| 4,843,400 | A * | 6/1989 | Tsao et al. | 343/700 MS |
| 5,982,326 | A * | 11/1999 | Chow et al. | 342/365 |
| 6,346,913 | B1 * | 2/2002 | Chang et al. | 343/700 MS |
| 2006/0187123 | A1 * | 8/2006 | Ando | 343/700 MS |
| 2010/0177012 | A1 * | 7/2010 | Morrow | 343/893 |

OTHER PUBLICATIONS

Kin-Lu Wong, Compact and Broadband Microstrip Antenna, Copyright 2002, John Wiley& Sons, Inc., pp. 287-324.*
Tai-Lee Chen and Hsu-Sheng Wu, "Dual-Polarized Planar Reflector Feed for Direct Broadcast Satellite Systems", IEEE Antennas and Wireless Propagation Letters, 2010, pp. 693-696, vol. 9, IEEE.

* cited by examiner

*Primary Examiner* — Dieu H Duong
(74) *Attorney, Agent, or Firm* — Cheng-Ju Chiang

(57) ABSTRACT

A dual-polarized dual-feeding planar antenna includes a first substrate, a second substrate and an air layer. The first substrate includes at least one first microstrip and at least one patch electrically connected with each other. The second substrate is disposed on one side of the first substrate and includes a common ground layer, a slot, a first feeding port, a second feeding port and a second microstrip. The slot is disposed corresponding to the patch. The air layer is disposed between the first substrate and the second substrate. The first microstrip is electrically connected to the first feeding port through a conducting wire. The patch couples to the second microstrip via the slot, and the second microstrip is electrically connected to the second feeding port.

6 Claims, 9 Drawing Sheets

DUAL-POLARIZED DUAL-FEEDING PLANAR ANTENNA

CROSS REFERENCE TO RELATED APPLICATIONS

This Non-provisional application claims priority under 35 U.S.C. §119(a) on Patent Application No(s). 099139594 filed in Taiwan, Republic of China on Nov. 17, 2010, the entire contents of which are hereby incorporated by reference.

BACKGROUND OF THE INVENTION

1. Field of Invention

The present invention relates to an antenna and, in particular, to a planar antenna.

2. Related Art

In the recent years, the satellite communication, especially for the live shows and TV programs, is rapidly developed, and thus more than ten commercial satellites are launched every year. In additional, the satellite TV channels increase and billion users are watching these channels. Accordingly, it is very important to develop a satellite signal receiving system that can provide good quality and function. In general, the satellite signal receiving antenna is commonly designed as a dish antenna, and the LNB feed thereof usually adopts the conventional horn antenna. In order to reduce the total volume, the feed antenna can be formed on a plate circuit board so as to create a planar antenna. The planar antenna has the advantages of low manufacturing cost, less weight, suitable for mass production, and easier integration with post circuits.

FIG. 1 is a schematic diagram showing a conventional planar antenna 1, which includes a substrate 11, a patch 13, a feeding port 14, a metal ground layer 15, and a microstrip 16.

The patch 13 is a rectangular metal patch, which is formed on the upper surface of the substrate 11 by circuit printing. In addition, the metal ground layer 15 is formed on the lower surface of the substrate 11. The patch 13 is electrically connected to the feeding port 14 through the microstrip 16, so that the energy can be fed into the patch 13. Then, the length and width of the microstrip 16 can be properly adjusted to achieve the desired impedance matching of the planar antenna 1.

The planar antenna 1 can be operated in the required bandwidth by adjusting the size and shape of the patch 13. After feeding energy into the feeding port 14, the electromagnetic field can be induced between the patch 13 and the metal ground layer 15, and then the electromagnetic wave is irradiated outwardly. For receiving signals by the antenna 1, the direction of the energy transfer is converse.

Regarding to the millimeter scaled wave, a single antenna may not obtain sufficient gain, so that the antenna array composed of multiple antennas is provided to reach the desired gain. FIG. 2 is a schematic diagram showing another conventional planar antenna 1*a*, which includes four patches 13. The four patches 13 are the same, and the microstrip 16 electrically connects the patches 13 to the feeding port 14 so as to feed the energy into the patches 13. Then, the length and width of the microstrip 16 can be properly adjusted to achieve the desired impedance matching of the planar antenna 1*a*.

The conventional planar antennas are single-polarized antennas, so they can only receive the signal from a single direction. This limits the applications of the antenna. Therefore, it is an important subject to provide an antenna that can achieve multiple polarizations, thereby increasing the utility variety.

SUMMARY OF THE INVENTION

In view of the foregoing subject, an objective of the present invention is to provide a dual-polarized dual-feeding planar antenna that can increase the utility variety.

To achieve the above objective, the present invention discloses a dual-polarized dual-feeding planar antenna including a first substrate, a second substrate and an air layer. The first substrate includes at least one first microstrip and at least one patch electrically connected with each other. The second substrate is disposed on one side of the first substrate and includes a common ground layer, a slot, a first feeding port, a second feeding port and a second microstrip. The slot is disposed corresponding to the patch. The air layer is disposed between the first substrate and the second substrate. The first microstrip is electrically connected to the first feeding port through a conducting wire. The patch couples to the second microstrip via the slot, and the second microstrip is electrically connected to the second feeding port.

In one embodiment of the present invention, the first microstrip and the patch are located on the same surface or different surfaces of the first substrate.

In one embodiment of the present invention, the shape of the patch is circular, elliptic, or rectangular.

In one embodiment of the present invention, the first microstrip is a suspension microstrip.

In one embodiment of the present invention, the second substrate has a first surface and a second surface, which are opposite to each other, and the first surface directly faces the first substrate.

In one embodiment of the present invention, the common ground layer and the slot are located on the first surface, and the second microstrip is located on the second surface.

In one embodiment of the present invention, the planar antenna further includes at least one spacer for separating the first substrate and the second substrate with a constant interval.

In one embodiment of the present invention, the amount of the patches is the same as that of the slots.

In one embodiment of the present invention, the planar antenna further includes at least one phase shift circuit electrically connected to the first feeding port and the second feeding port.

In one embodiment of the present invention, the planar antenna is a satellite antenna.

In one embodiment of the present invention, an operation bandwidth of the first feeding port and the second feeding port is substantially 12.1 GHz.

As mentioned above, the dual-polarized dual-feeding planar antenna of the present invention has an air layer disposed between two substrates, so that it is more flexible in various design purposes such as for bandwidths, beamwidths or impedance matching. In this invention, the first microstrip and the conductive wire are electrically connected to the first feeding port so as to provide a first polarization direction. In addition, the patch couples to the second microstrip via the slot and the second microstrip is electrically connected to the second feeding port, so that the energy of the patch can be coupled to the second microstrip through the slot and the second feeding port so as to provide a second polarization direction. Moreover, the common ground layer can separate two feeding ports, so the isolation between two feeding ports can be enhanced. In practice, the increased isolation can decrease the electromagnetic interference between the antenna and the post circuits. Compared with the prior art, the present invention can utilize the dual-feeding design to induce two polarization directions so as to increasing the utility variety.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
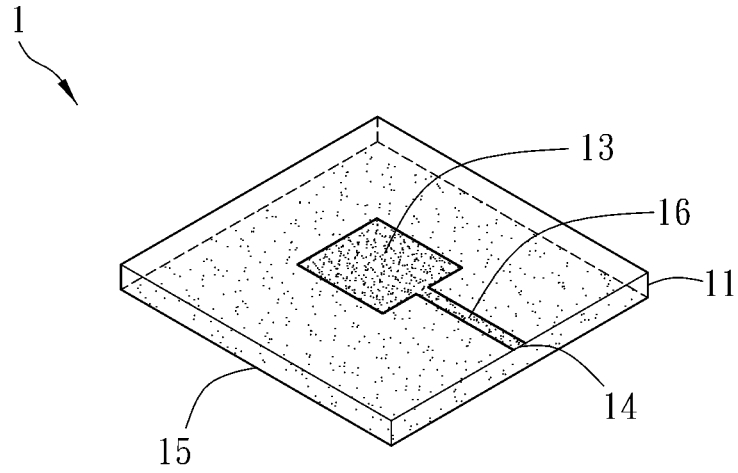
FIG. 1(Prior Art)
FIG. 1 is a schematic diagram showing a conventional planar antenna.
Figure 2:
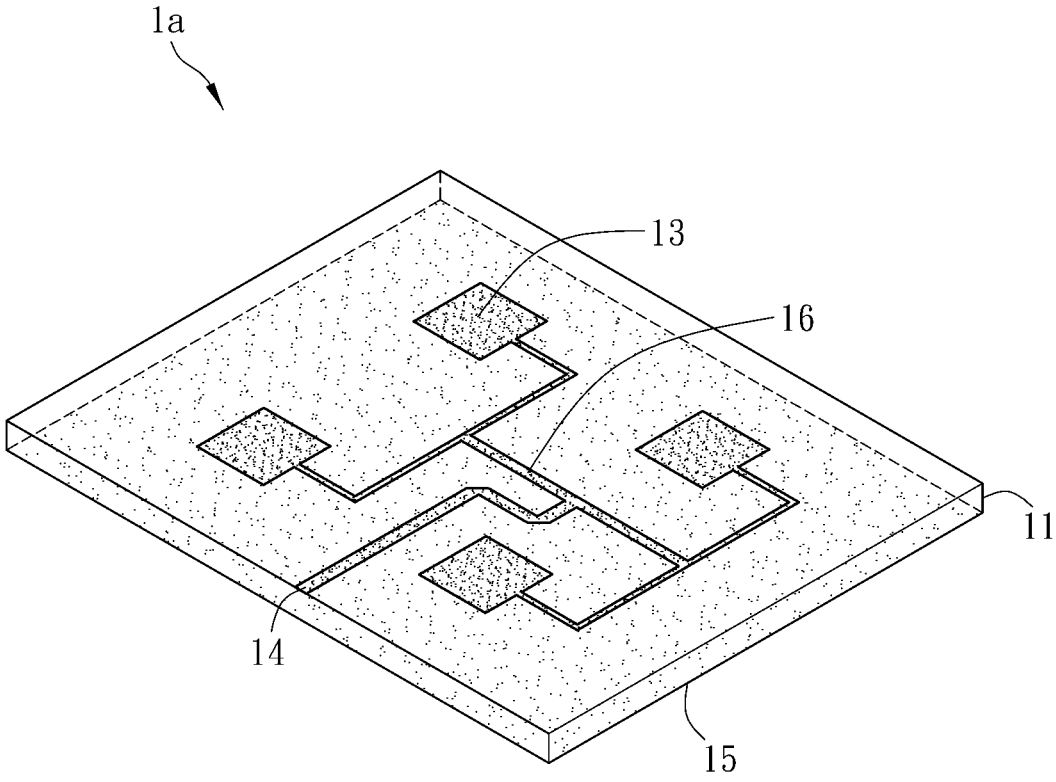
FIG. 2(Prior Art)
FIG. 2 is a schematic diagram showing another conventional planar antenna.
Figure 3A:
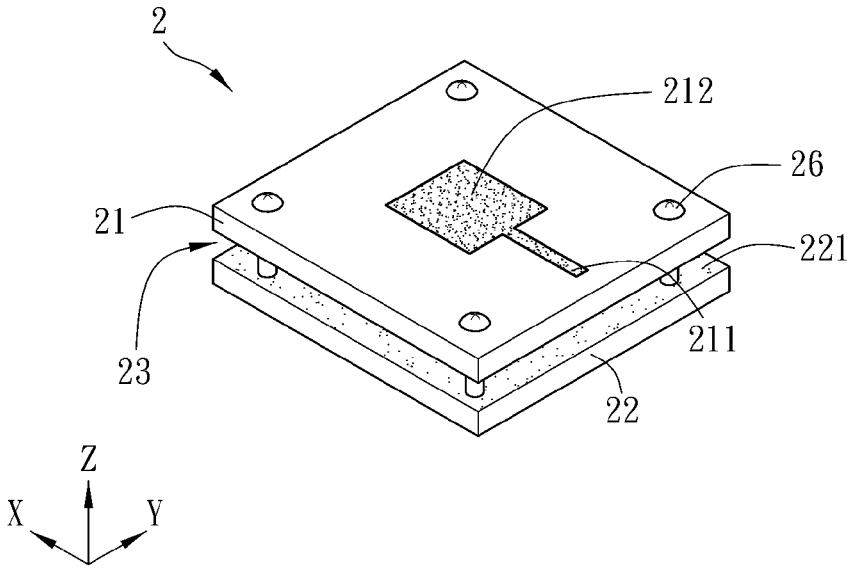
FIG. 3A is a schematic diagram showing a dual-polarized dual-feeding planar antenna according to a first embodiment of the present invention.
Figure 3B:
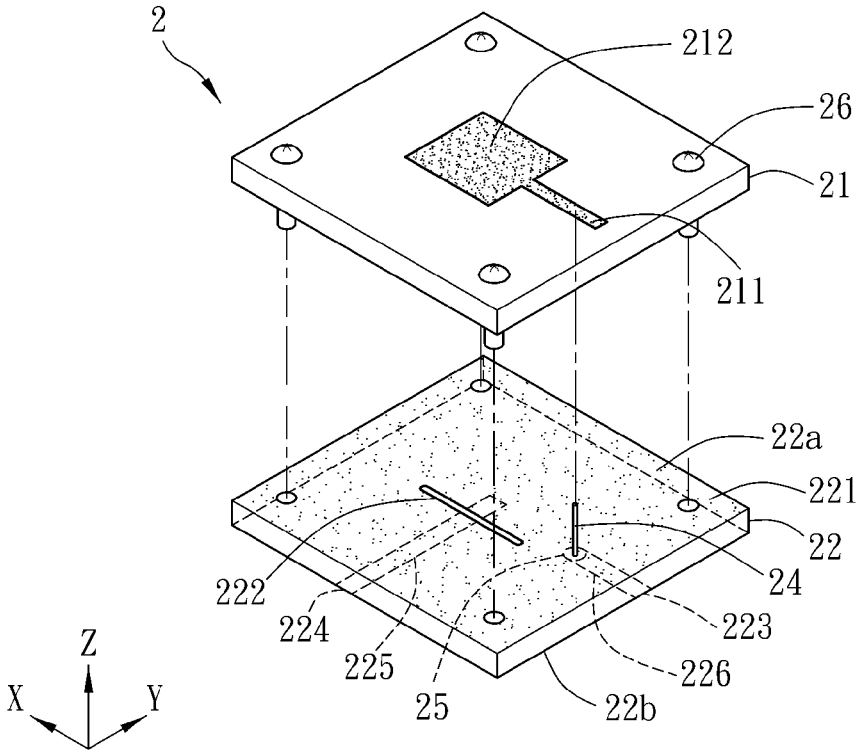
FIG. 3B is an exploded view of the dual-polarized dual-feeding planar antenna according to the first embodiment of the present invention.

FIG. 3A is a schematic diagram showing a dual-polarized dual-feeding planar antenna 2 according to a first embodiment of the present invention, and FIG. 3B is an exploded view of the dual-polarized dual-feeding planar antenna 2. Referring to FIGS. 3A and 3B, the dual-polarized dual-feeding planar antenna 2 includes a first substrate 21, a second substrate 22 and an air layer 23.

The first substrate 21 includes a first microstrip 211 and a patch 212 electrically connected with each other. The shape of the patch 212 can be circular, elliptic, or rectangular. In this embodiment, the first substrate 21 is a printed circuit board and includes only one patch 212, and the patch 212 is, for example, a rectangular patch, which is formed on the surface of the first substrate 21 by the circuit printing process. In addition, the first microstrip 211 and the patch 212 can be located on the same surface or different surfaces of the first substrate 21. In this embodiment, the first microstrip 211 and the patch 212 are located on the same surface, which is the upper surface of the first substrate 21. To be noted, if the first microstrip 211 and the patch 212 are located on different surfaces of the first substrate 21, they can be electrically connected to each other through a via. For example, one of the first microstrip 211 and the patch 212 is located on the upper surface of the first substrate 21, and the other one is located on the lower surface thereof.

The second substrate 22 is disposed on one side of the first substrate 21 and includes a common ground layer 221, a slot 222, a first feeding port 223, a second feeding port 224, and a second microstrip 225. In this embodiment, the second substrate 22 is also a printed circuit board, and has a first surface 22*a* and a second surface 22*b*, which are disposed opposite to each other. The first surface 22*a* directly faces the first substrate 21. The common ground layer 221 and the slot 222 are disposed on the first surface 22*a*, and the second microstrip 225 is disposed on the second surface 22*b*.

The air layer 23 is disposed between the first substrate 21 and the second substrate 22. A conducting wire 24 passes through the air layer 23 to electrically connect the first microstrip 211 to the first feeding port 223. In addition, the slot 222 is disposed corresponding to the patch 212. If there are multiple patches 212 and multiple slots 222, the amount of the patches 212 is the same as that of the slots 222. Accordingly, the energy received by the patch 212 can be coupled to the second microstrip 225 via the slot 222. In addition, and the second microstrip 225 is electrically connected to the second feeding port 224. Since the air layer 23 is configured between the first substrate 21 and the second substrate 22, the first microstrip 211 of the first substrate 21 becomes a suspension microstrip, which can increase the gain and bandwidth of the planar antenna 2.

The dual-polarized dual-feeding planar antenna 2 further includes at least one spacer 26 for separating the first substrate 21 and the second substrate 22 with a constant interval. In this embodiment, there are four spacers 26 disposed at four corners of the first and second substrates 21 and 22. For example, the spacer 26 can be a plastic bolt. In general, if the interval increases, the thickness of the air layer 23 also increases. Since the interval can be properly verified, the design flexibility, such as for purposes of bandwidths, beamwidths or impedance matching, can be increased.

People skilled in the art know that the operation frequency of the antenna relates to the dimension thereof, and the dimension of the antenna can be modified based on the desired operation frequency. In the current embodiment, the length of the patch 212 is about a half of the guided wavelength of the operation frequency of the dual-polarized dual-feeding planar antenna 2.

In this embodiment, after the patch 212 receives the electromagnetic signal, a resonance current on the X-direction can be induced and then flow into the conductive wire 24 through the first microstrip 211. Since the conductive wire 24 is electrically connected to a feeding line 226 on the second surface 22*b* through the via 25 of the second substrate 22 and then electrically connected to the first feeding port 223, the first polarization direction can be provided. In addition, after the patch 212 receives the electromagnetic signal, a resonance current on the Y-direction can be induced and then the energy can be coupled to the second microstrip 225 of the second surface 22*b* through the slot 222 of the common ground layer 221. Then, the resonance current on the Y-direction can flow into the second feeding port 224 so as to provide the second polarization direction. Herein, the first and second polarization directions are substantially perpendicular to each other. In this embodiment, the first feeding port 223 and the second feeding port 224 are usually 50Ω feeding ports, which can be integrated with the following down converter circuit. To be noted, to use the common ground layer 221 to separate two feeding ports can not only increase the isolation between the first and second feeding ports 223 and 224, but also decrease the electromagnetic interference between the antenna and the post circuit.

Figure 4:
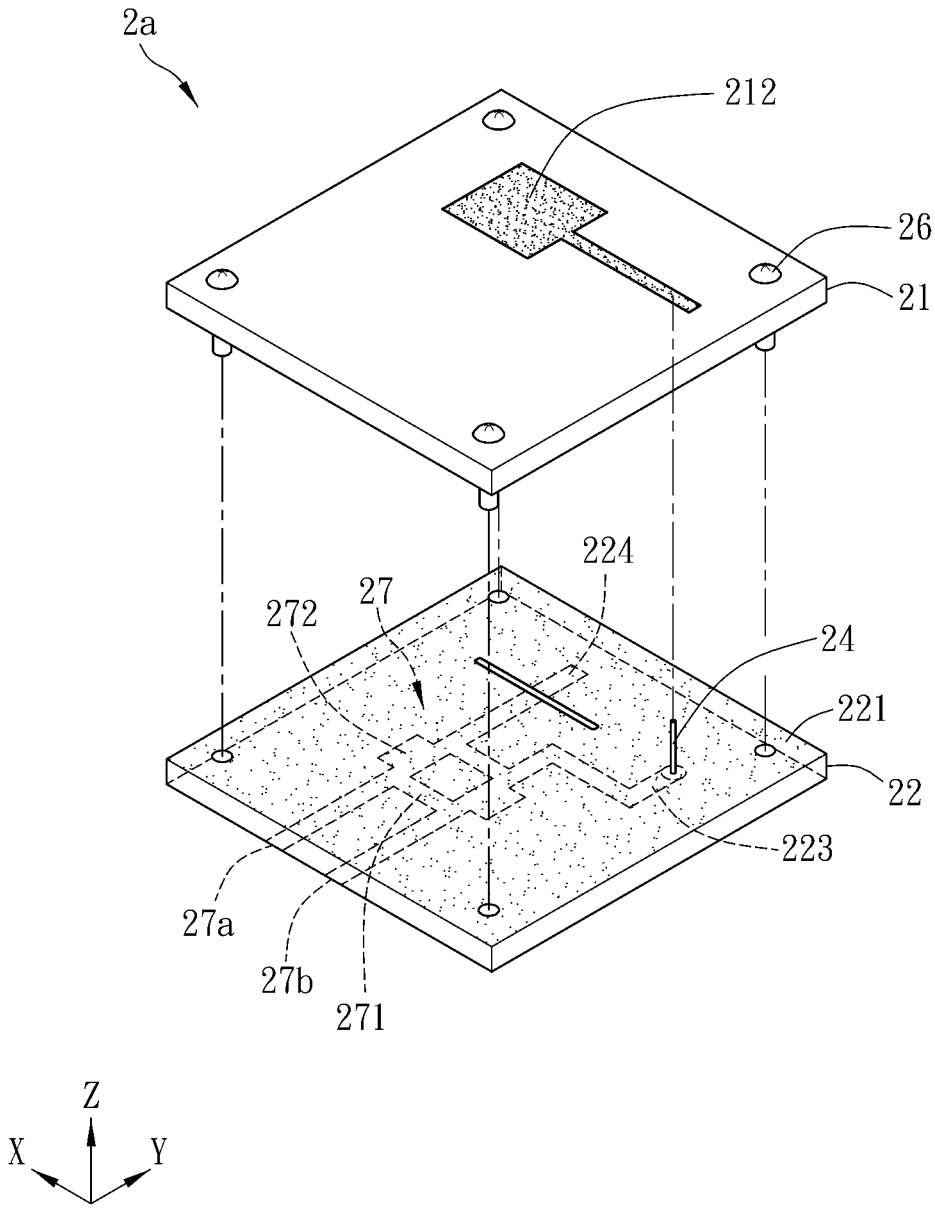
FIG. 4 is an exploded view of a dual-polarized dual-feeding planar antenna according to a second embodiment of the present invention.

FIG. 4 is an exploded view of a dual-polarized dual-feeding planar antenna 2*a* according to a second embodiment of the present invention. Referring to FIG. 4, the dual-polarized dual-feeding planar antenna 2*a* further includes a phase shift circuit 27, which is electrically connected with the first and second feeding ports 223 and 224. In this embodiment, the phase shift circuit 27 is, for example, a branch line coupler, and the feeding port 27*b* of the phase shift circuit 27 usually connects to a 50Ω load. Since the electrical length of each of the sections 271 and 272 of the coupler is about a quarter of the wavelength of the operation bandwidth, the phase difference between the first and second feeding ports 223 and 224 is 90 degrees as the energy is fed into the feeding port 27*a*. This can obtain a circular polarization antenna, which is capable of achieving right or left circular polarization.

Figure 5A:
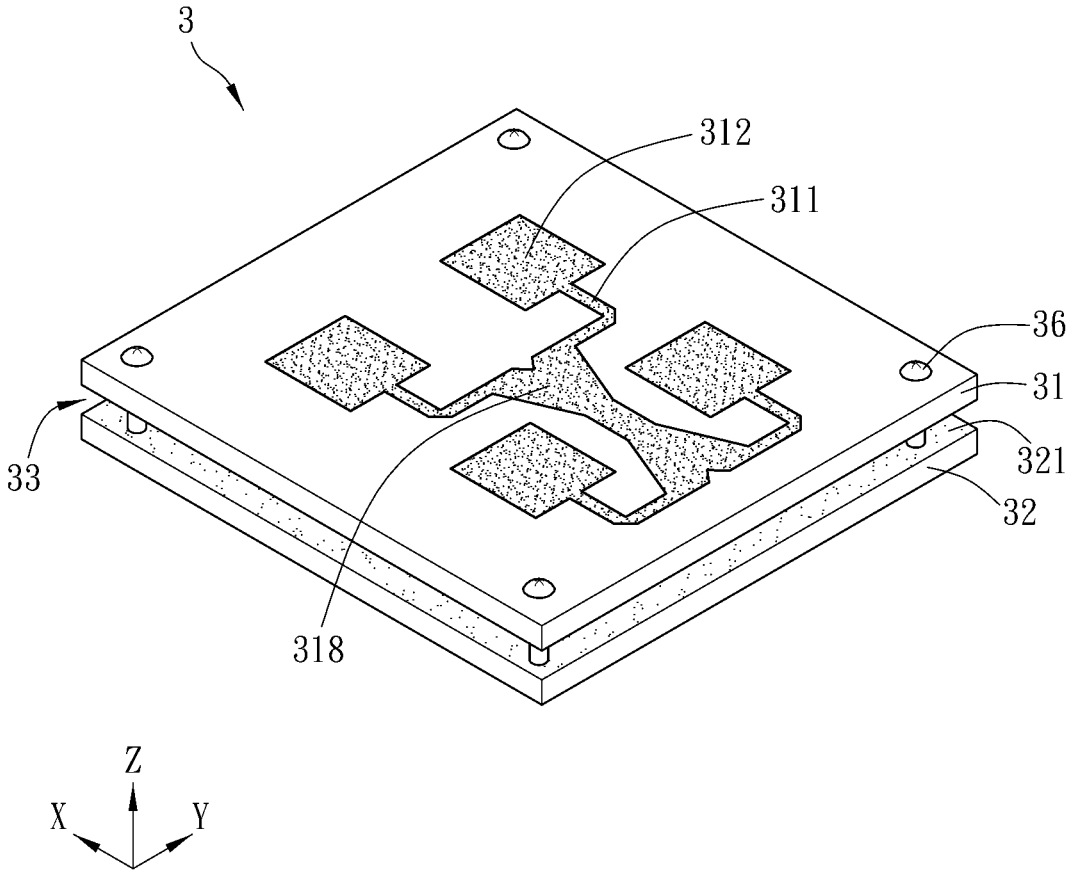
FIG. 5A is a schematic diagram showing a dual-polarized dual-feeding planar antenna according to a third embodiment of the present invention.
Figure 5B:
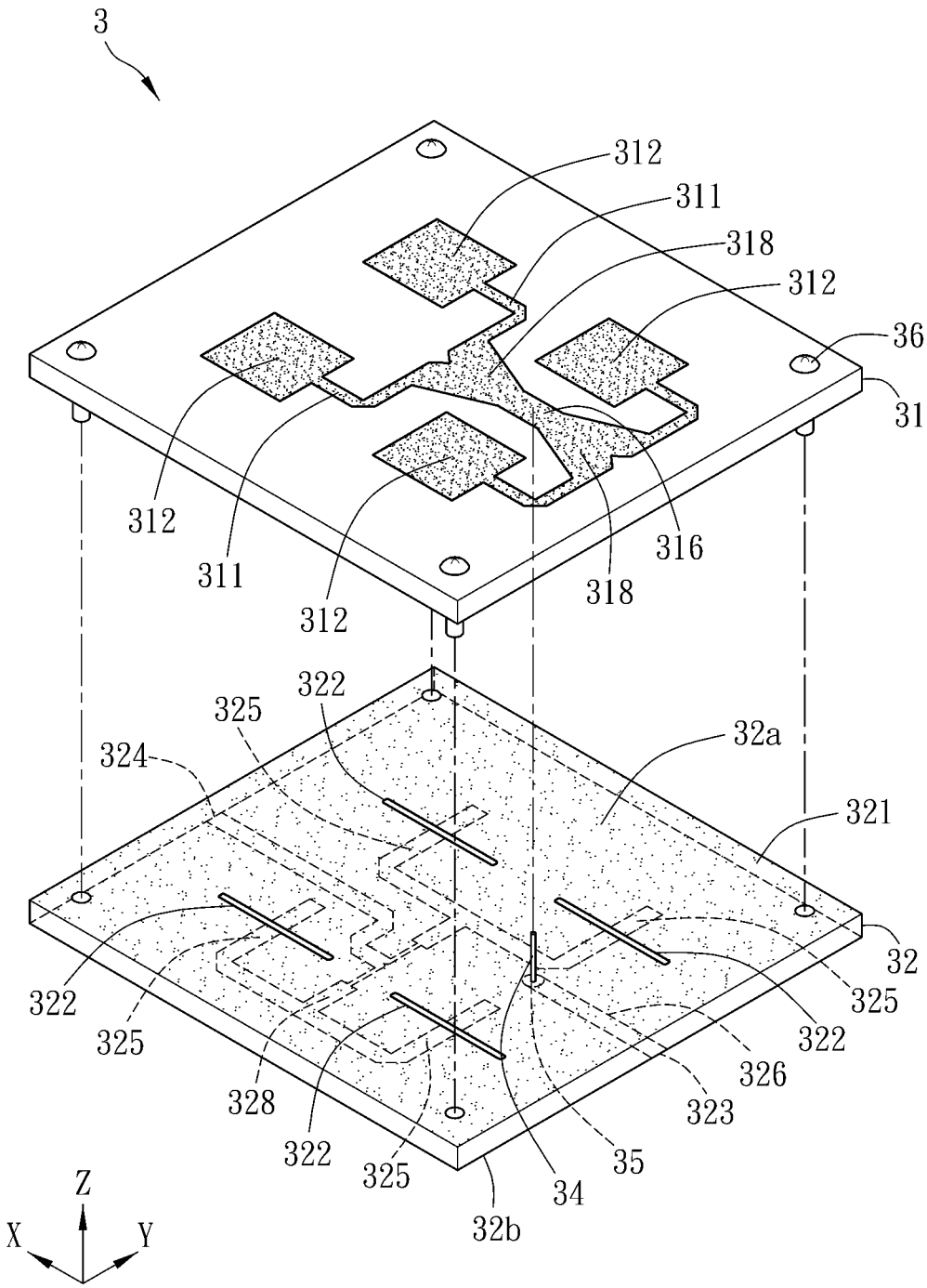
FIG. 5B is an exploded view of the dual-polarized dual-feeding planar antenna according to the third embodiment of the present invention.

FIG. 5A is a schematic diagram showing a dual-polarized dual-feeding planar antenna 3 according to a third embodiment of the present invention, and FIG. 5B is an exploded view thereof. The antenna array composed of a plurality of patches is provided to reach the desired gain.

In this embodiment, the dual-polarized dual-feeding planar antenna 3 is a 2×2 array for example. Besides, the first substrate 31 of the dual-polarized dual-feeding planar antenna 3 further includes an impedance converter 318, which is electrically connected to the first microstrip 311. In addition, the second substrate 32 also includes an impedance converter 328, which is electrically connected to the second microstrip 325. Herein, the impedance converters 318 and 328 are used for impedance matching. The impedance converter 318 is a taper quarter-wavelength impedance converter, which can reduce the discontinuous effect during impedance converting.

In this embodiment, the planar antenna 3 also includes, for example, four spacers 36, which are disposed at four corners of the rectangular first and second substrates 31 and 32. After the patches 312 receive the electromagnetic signal, resonance currents on the X-direction can be induced and then separately flow into two impedance converters 318 through four first microstrips 311. Then, the electromagnetic signal can flow into the conductive wire 34 through the microstrip 316 disposed between two impedance converters 318. Since the conductive wire 34 is electrically connected to a feeding line 326 through a via 35 of the second substrate 32 and then electrically connected to the first feeding port 323, the first polarization direction can be provided. In addition, after four patches 312 receives the electromagnetic signal, resonance currents on the Y-direction can be induced and then the energy can be coupled to the second microstrips 325 of through the slots 322 of the common ground layer 321. The second microstrips 325 are separately connected to two impedance converters 328, so that the resonance currents on the Y-direction can flow into the second feeding port 324 so as to provide the second polarization direction. Herein, the first and second polarization directions are substantially perpendicular to each other. In this embodiment, the first feeding port 323 and the second feeding port 324 are usually 50Ω feeding ports, which can be integrated with the following down converter circuit. To be noted, to use the common ground layer 321 to separate two feeding ports can not only increase the isolation between the first and second feeding ports 323 and 324, but also decrease the electromagnetic interference between the antenna and the post circuit.

Figure 6A:
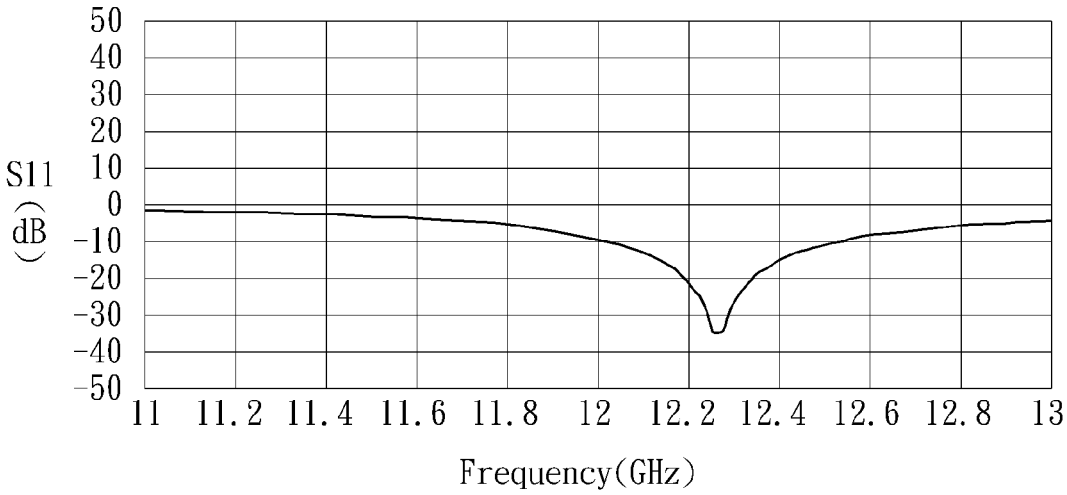
FIGS. 6A and 6B are reflection coefficient measurement diagrams of the dual-polarized dual-feeding planar antenna according to the third embodiment of the present invention.
Figure 6B:
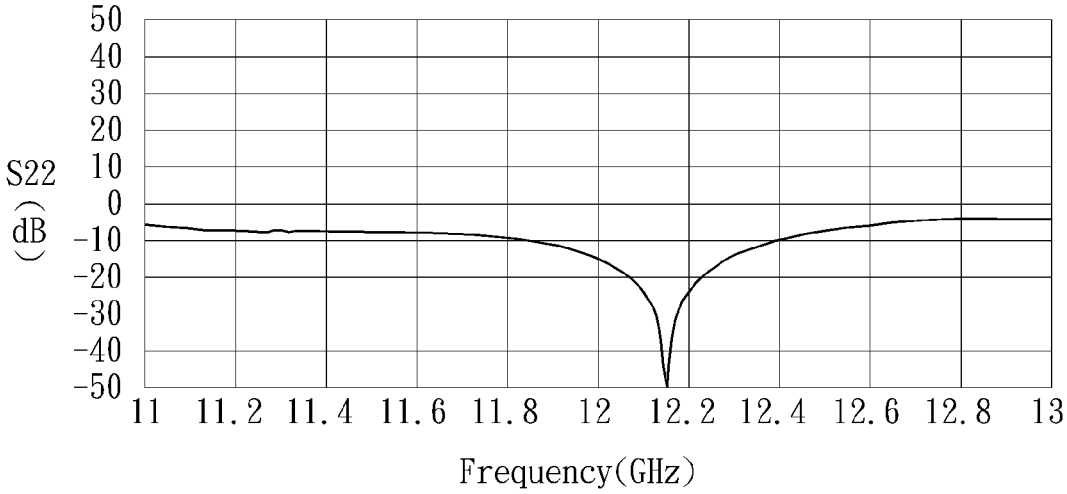
Figure 7A:
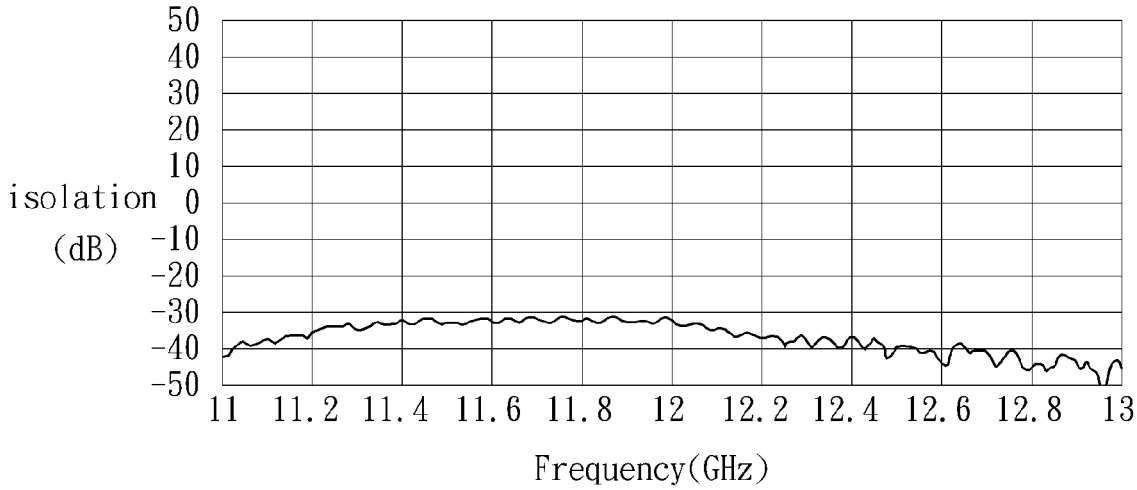
FIGS. 7A and 7B are isolation measurement diagrams of the first and second feeding ports of the dual-polarized dual-feeding planar antenna according to the third embodiment of the present invention.
Figure 7B:
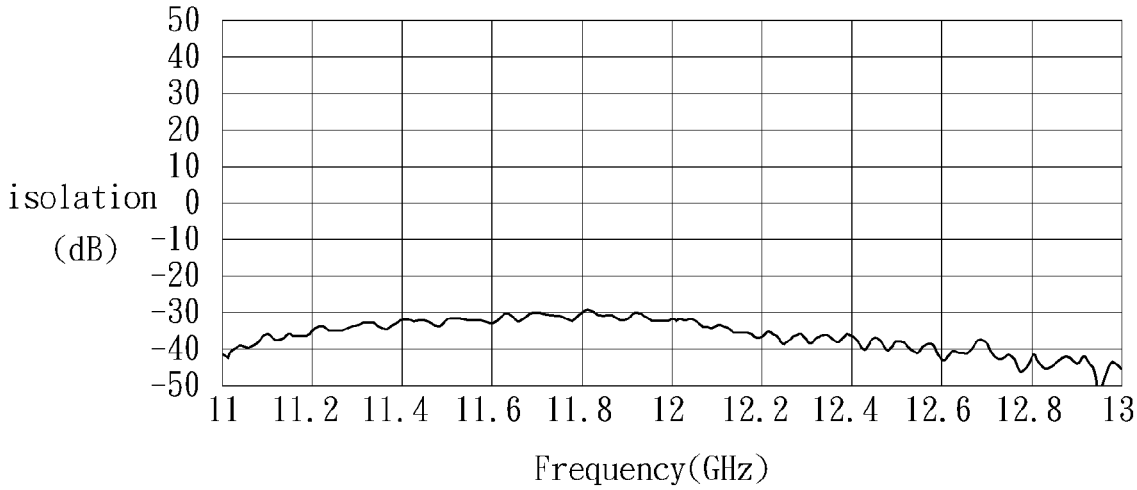

FIGS. 6A and 6B are reflection coefficient measurement diagrams of the dual-polarized dual-feeding planar antenna 3 according to the third embodiment of the present invention. With reference to FIGS. 6A and 6B in view of FIG. 5A, the operation bandwidths of the first feeding port 323 and the second feeding port 324 are both around 12.1 GHz, which is a satellite TV receiving bandwidth. Herein, S11 and S12 represent the reflection coefficients of the first feeding port 323 and the second feeding port 324, respectively. FIGS. 7A and 7B are isolation measurement diagrams of the first and second feeding ports 323 and 324 of the dual-polarized dual-feeding planar antenna 3 according to the third embodiment of the present invention. The isolation within the operation bandwidth is about 35 dB, which means that the electromagnetic interference between two feeding ports is quite low.

Figure 8:
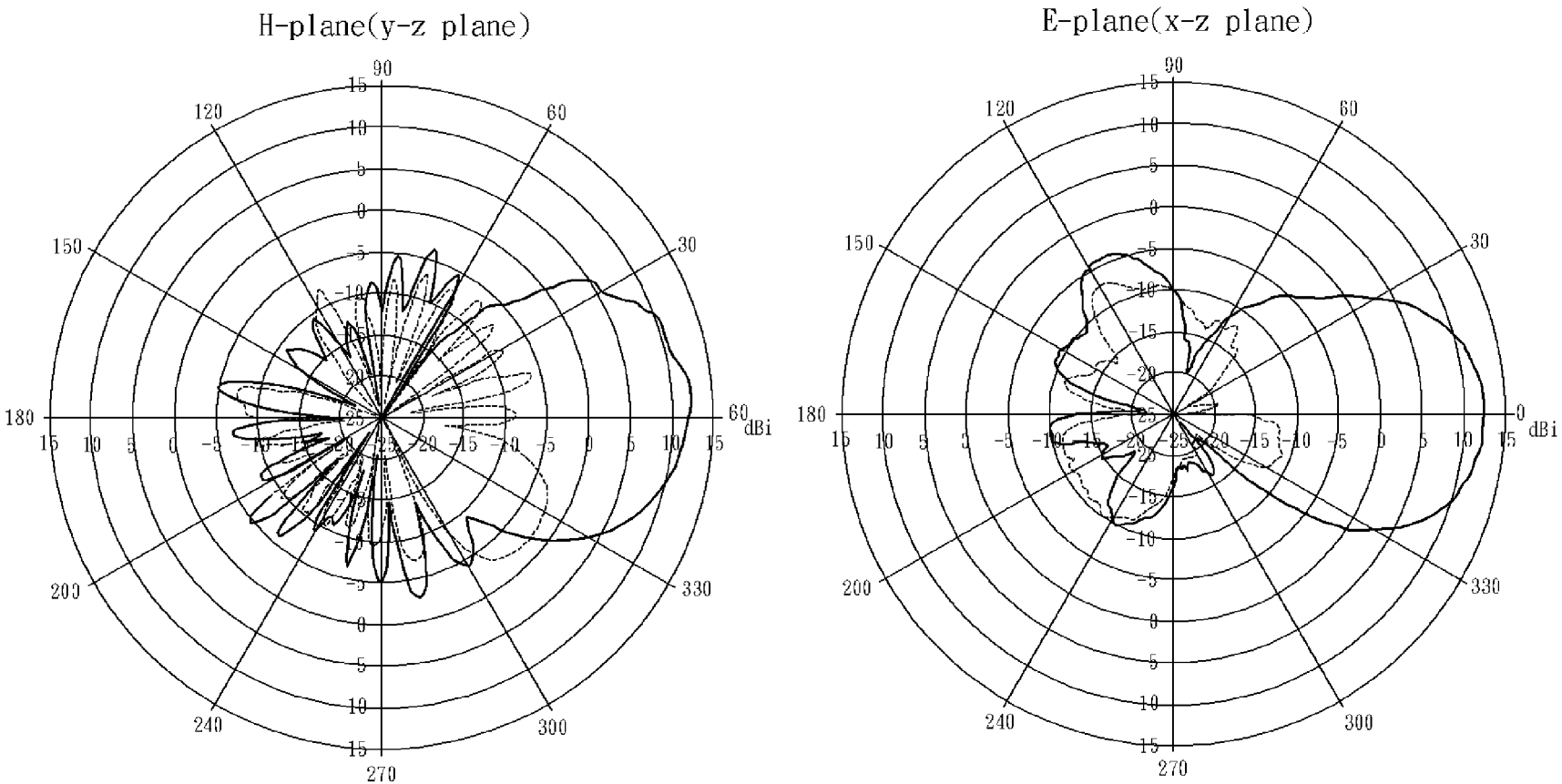
FIGS. 8 and 9 are radiation field patterns of the dual-polarized dual-feeding planar antenna according to the third embodiment of the present invention while operating in 12.1 GHz.
Figure 9:
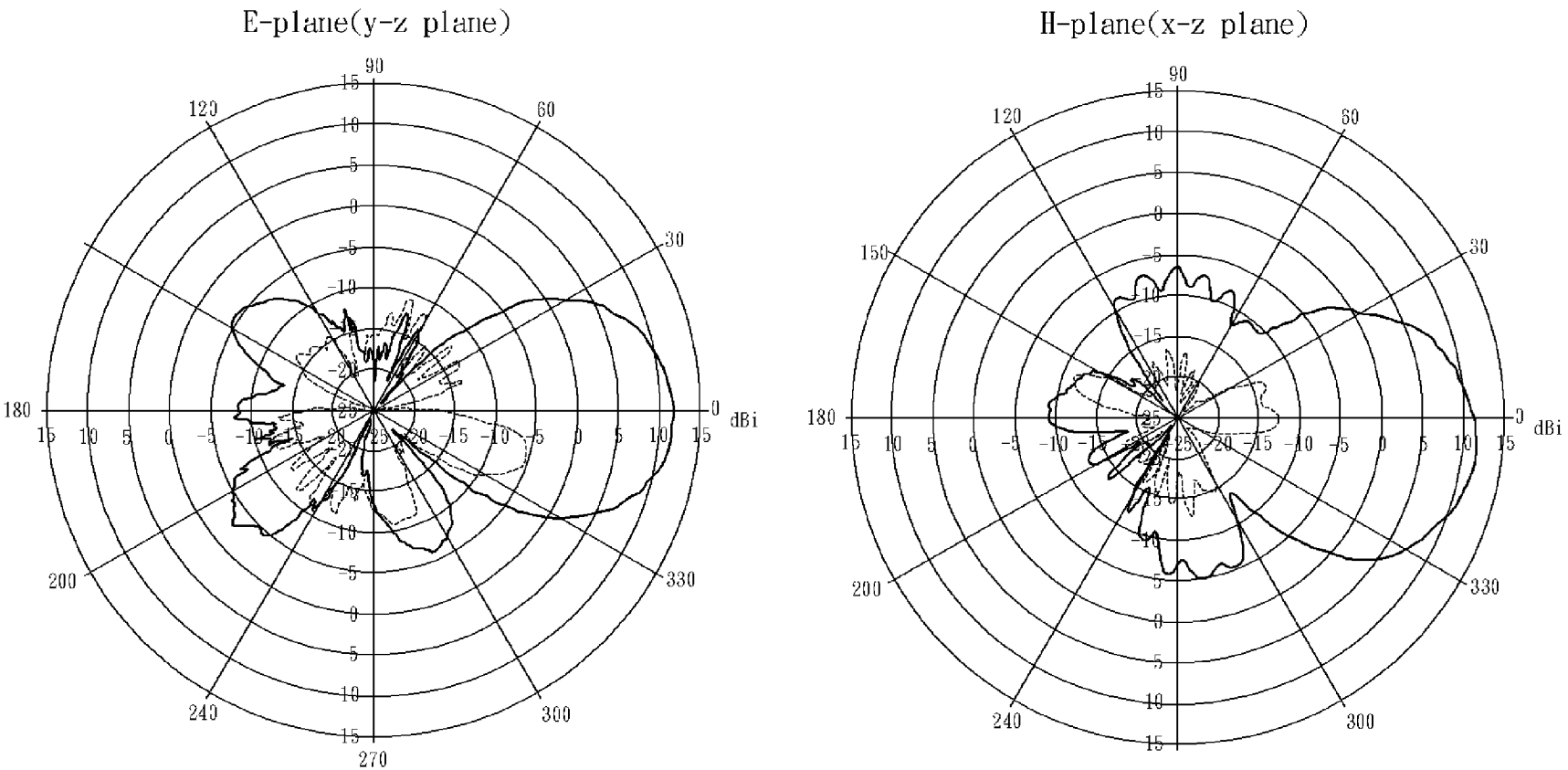

FIGS. 8 and 9 are radiation field patterns of the dual-polarized dual-feeding planar antenna 3 according to the third embodiment of the present invention while operating in 12.1 GHz. The solid line in FIG. 8 represents the radiation field pattern of the first feeding port 323, and the dotted line in FIG. 8 represents the cross polarization radiation field pattern, which is measured from the second feeding port 324. The solid line in FIG. 9 represents the radiation field pattern of the second feeding port 324, and the dotted line in FIG. 9 represents the cross polarization radiation field pattern, which is measured from the first feeding port 323. The cross polarization effect is below 15 dB. According to the measurements, when operating under 12.1 GHz, the gains of two feeding ports 323 and 324 are both around 12 dBi, and the 10 dB beamwidth is about 70 degrees. The measuring results are the same as that of the conventional feeding horn antenna utilized in the direct broadcast satellite down converter.

In summary, the dual-polarized dual-feeding planar antenna of the present invention has an air layer disposed between two substrates, so that it is more flexible in various design purposes such as for bandwidths, antenna gain or impedance matching. In this invention, the first microstrip and the conductive wire are electrically connected to the first feeding port so as to provide one polarization direction. In addition, the patch couples to the second microstrip via the slot and the second microstrip is electrically connected to the second feeding port, so that the energy of the patch can be coupled to the second microstrip through the slot and the second feeding port so as to provide another polarization direction. Moreover, the common ground layer can separate two feeding ports, so the isolation between two feeding ports can be enhanced. In practice, the increased isolation can decrease the electromagnetic interference between the antenna and the postcircuit. Compared with the prior art, the present invention can utilize the dual-feeding design to induce two polarization directions so as to increasing the utility variety.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dual-polarized dual-feeding planar antenna, comprising:

a first substrate comprising at least a first microstrip and at least a patch;

a second substrate disposed on one side of the first substrate and comprising a common ground layer, a slot, a first feeding port, a second feeding port, and a second microstrip, wherein the slot is disposed corresponding to the patch; and an air layer disposed between the first substrate and the second substrate, wherein the first microstrip is electrically connected to the first feeding port through a conducting wire, the patch couples to the second microstrip via the slot, and the second microstrip is electrically connected to the second feeding port;

wherein the first microstrip is located outside of the patch, one end of the first microstrip is electrically connected to the patch, and the other end of the first microstrip is electrically connected to the conducting wire, and the conducting wire passes through the air layer to electrically connect the first feeding port.

2. The planar antenna of claim 1, wherein the first microstrip and the patch are located on the same surface or different surfaces of the first substrate.

3. The planar antenna of claim 1, wherein the shape of the patch is circular, elliptic, or rectangular.

4. The planar antenna of claim 1, wherein the first microstrip is a suspension microstrip.

5. The planar antenna of claim 1, wherein the second substrate has a first surface and a second surface, which are opposite to each other, and the first surface directly faces the first substrate.

6. The planar antenna of claim 5, wherein the common ground layer and the slot are located on the first surface, and the second microstrip is located on the second surface.

* * * * *